US006748870B2

(12) United States Patent
Heidenreich et al.

(10) Patent No.: US 6,748,870 B2
(45) Date of Patent: Jun. 15, 2004

(54) AMMUNITION ROUND ASSEMBLY WITH COMBUSTIBLE CARTRIDGE CASE

(75) Inventors: Paul D. Heidenreich, San Diego, CA (US); Enrico R. Mutascio, Palm Springs, CA (US); James M. Krushat, Palm Springs, CA (US); Bogdan I. Vladescu, La Quinta, CA (US)

(73) Assignee: Armtec Defense Products Company, Coachella, CA (US)

( * ) Notice: Subject to any disclaimer, the term of this patent is extended or adjusted under 35 U.S.C. 154(b) by 0 days.

(21) Appl. No.: 10/278,716

(22) Filed: Oct. 22, 2002

(65) Prior Publication Data

US 2003/0167952 A1 Sep. 11, 2003

Related U.S. Application Data

(60) Provisional application No. 60/331,082, filed on Oct. 22, 2001.

(51) Int. Cl.[7] ..... F42B 5/18

(52) U.S. Cl. ..... 102/431; 102/465; 102/700

(58) Field of Search ..... 102/430, 431, 102/432, 465, 466, 467, 700

(56) References Cited

U.S. PATENT DOCUMENTS

| | | | | |
|---|---|---|---|---|
| 2,072,671 A | | 3/1937 | Foulke | |
| 2,862,446 A | | 12/1958 | Ringdal | |
| 2,866,412 A | | 12/1958 | Meyer et al. | |
| 2,996,988 A | | 8/1961 | Kunz | |
| 3,705,549 A | | 12/1972 | Quinlan et al. | |
| 3,808,973 A | * | 5/1974 | Galluzzi | 102/376 |
| 3,955,506 A | | 5/1976 | Luther et al. | |
| 4,015,527 A | | 4/1977 | Evans | |
| 4,197,801 A | | 4/1980 | LaFever et al. | |
| 4,220,089 A | | 9/1980 | Smith | |
| 4,335,657 A | | 6/1982 | Bains | |

FOREIGN PATENT DOCUMENTS

| | | | | |
|---|---|---|---|---|
| DE | 27 05 235 | | 8/1978 | |
| EP | 463904 A | * | 1/1992 | F42B/5/18 |
| EP | 0 483 787 | | 5/1992 | |
| EP | 0 307 307 B1 | | 7/1992 | |
| FR | 2702554 A1 | * | 9/1994 | F42B/5/18 |
| GB | 732633 | | 6/1955 | |
| GB | 2 044 416 | | 10/1980 | |
| WO | WO 94/20813 A1 | | 9/1994 | |
| WO | WO 94/20814 A1 | | 9/1994 | |
| WO | WO 99/24778 | | 5/1999 | |

OTHER PUBLICATIONS

Tim Thompson, Dipak Kamdar, "Computer Modeling of Pressures on 120mm Tank Round in the M256 Gun" presented at The National Defense Industiral Association 36th Annual Gun & Ammunition Symposium & Exhibition, Apr. 10, 2001, Alliant Techsystems.*

International Search Report dated Mar. 28, 2003 for PCT Application PCT/US/02/33906.

(List continued on next page.)

*Primary Examiner*—Michael J. Carone
*Assistant Examiner*—Gabriel S. Sukman
(74) *Attorney, Agent, or Firm*—Perkins Coie LLP

(57) ABSTRACT

An ammunition round assembly having a combustible cartridge is provided. In one embodiment, the ammunition round assembly comprises a cartridge body made of a combustible material consumed in combustion upon firing the ammunition round assembly. A base is releasably connected to the cartridge body's bottom end portion. A retention member is positioned in a locking groove defined by groove in the cartridge body and the base. A projectile is positioned adjacent to the top end portion of the cartridge body. An attachment sleeve releasably connects the projectile and the cartridge body. The attachment sleeve has a connection member releasably engaging the connection member on the top end portion of the cartridge body. The attachment sleeve is configured to resist longitudinal motion of the projectile relative to the cartridge body until the ammunition round assembly is fired.

33 Claims, 4 Drawing Sheets

U.S. PATENT DOCUMENTS 4,444,115 A 4/1984 Romer et al.
4,535,697 A 8/1985 Moser et al.
4,593,622 A 6/1986 Fibranz
4,604,954 A 8/1986 Clarke et al.
4,640,195 A 2/1987 Campoli
4,763,577 A 8/1988 Romer et al.
4,802,415 A 2/1989 Clarke et al.
4,907,510 A 3/1990 Martwick et al.
4,941,244 A * 7/1990 Ortmann et al. ..... 86/52
5,042,388 A 8/1991 Warren et al.
5,090,323 A * 2/1992 Kallevig et al. ..... 102/282
5,138,949 A * 8/1992 Swartout et al. ..... 102/431
5,155,295 A 10/1992 Campoli
5,160,804 A 11/1992 Wähner et al.
5,233,928 A 8/1993 Ducros et al.
5,265,540 A 11/1993 Ducros et al.
5,333,551 A 8/1994 Heitmann et al.
5,388,522 A 2/1995 Martwick et al.
5,415,104 A 5/1995 Bispling et al.
5,433,148 A 7/1995 Barratault et al.
5,467,716 A 11/1995 Boual
5,557,059 A 9/1996 Warren et al.
5,563,365 A * 10/1996 Dineen et al. ..... 102/431
5,841,062 A 11/1998 Manole et al.
6,119,600 A 9/2000 Burri
6,158,348 A 12/2000 Campoli
6,450,099 B1 * 9/2002 Desgland ..... 102/431
6,457,603 B1 * 10/2002 Freist et al. ..... 220/678

* cited by examiner

AMMUNITION ROUND ASSEMBLY WITH COMBUSTIBLE CARTRIDGE CASE

CROSS-REFERENCE TO RELATED APPLICATIONS

This non-provisional application claims priority to Provisional U.S. Patent Application No. 60/331,082, entitled AMMUNITION ROUND ASSEMBLY WITH COMBUSTIBLE CARTRIDGE CASE, filed Oct. 22, 2001, hereby incorporated herein in its entirety by reference thereto.

BACKGROUND

In the 1950s and 60s, the United States Army conducted armament evaluations and adopted selected armament cannons and ammunition families. As an example, the armament selected for the XM60 main battle tank (MBT) was the M68 cannon and the British 105 mm×617 mm ammunition suite. This ammunition suite was metallic cased using 70:30 cartridge case brass with a range of projectiles. As the 105 mm×617 mm ammunition suite matured, steel was substituted for the brass in cartridge case manufacture. Over time, the 105 mm cannon and ammunition suite was replaced by a 120 mm smoothbore cannon with its associated 120 mm ammunition suite. The 120 mm ammunition suite utilized combustible cartridge cases, manufactured by Armtec Defense Products of Coachella, Calif., in part because the combustible cartridge cases have very high operating pressures. At these high operating pressures, metallic cartridge cases plastically deform during firing and can result in cartridge cases unable to be extracted from the cannon's firing chamber.

In the fall of 1999, 105 mm armament systems were evaluated as part of an infantry-centric doctrine to be used as a mobile assault cannon. The available 105 mm armament systems utilized the 20-year-old technology that had significant drawbacks. As an example, the prior technology could not adequately meet the strict weight restrictions of the air transportable mobile assault cannon. In addition, large caliber (e.g., 105 mm) metallic cartridge cases were not being domestically manufactured en masse at the time of the evaluation. In addition, the technology and designs for the 120 mm armament suite were not economically and adequately scaled down to a 105 mm armament suite, while maintaining the required performance criteria for the mobile assault cannon.

SUMMARY OF THE INVENTION

Under one aspect of the present invention, an ammunition round assembly having a combustible cartridge is provided. Under another aspect, an armament system comprising a firing device and an ammunition round assembly with a combustible cartridge case is provided.

In one embodiment, the ammunition round assembly comprises a cartridge body made of a combustible material consumed in combustion upon firing the ammunition round assembly. The cartridge body has a bottom end portion with a first retaining groove therein. A base is connected to the cartridge body's bottom end portion. The base has a second retaining groove radially adjacent to the first retaining groove. The first and second retaining grooves define a locking groove between the base and the cartridge body. A retention member is positioned in the locking groove and engages the cartridge body and the base in the first and second retaining grooves to hold the cartridge body and the base together until the ammunition round assembly is fired.

A projectile is adjacent to a top end portion of the cartridge body, and an attachment member releasably connects the projectile to the top end portion of the cartridge body.

In another embodiment, the ammunition round assembly has a combustible cartridge body, and a base is connected to a bottom end portion of the cartridge body. A projectile is positioned adjacent to the top end portion of the cartridge body. An attachment member connects the projectile and the cartridge body. The attachment member has a connection member releasably engaging the connection member on the top end portion of the cartridge body. The attachment member is configured to resist longitudinal motion of the projectile relative to the cartridge body.

DETAILED DESCRIPTION

In the following description, certain specific details are set forth in order to provide a thorough understanding of various embodiments of the invention. However, one skilled in the art will understand that the invention may be practiced without these details. In other instances, well-known structures associated with ammunition rounds, including medium to large caliber ammunition rounds, have not been shown or described in detail to avoid unnecessarily obscuring the description of the embodiments of the invention. FIGS. 1–5 illustrate a system and components of the ammunition round assembly with combustible cartridge case in accordance with the embodiments of the present invention. Several of the components described below with reference to FIGS. 1–5 can also be used for performing methods in accordance with aspects of the present invention. Therefore, like references refer to like components and features throughout the various figures.

Figures 1, 3:
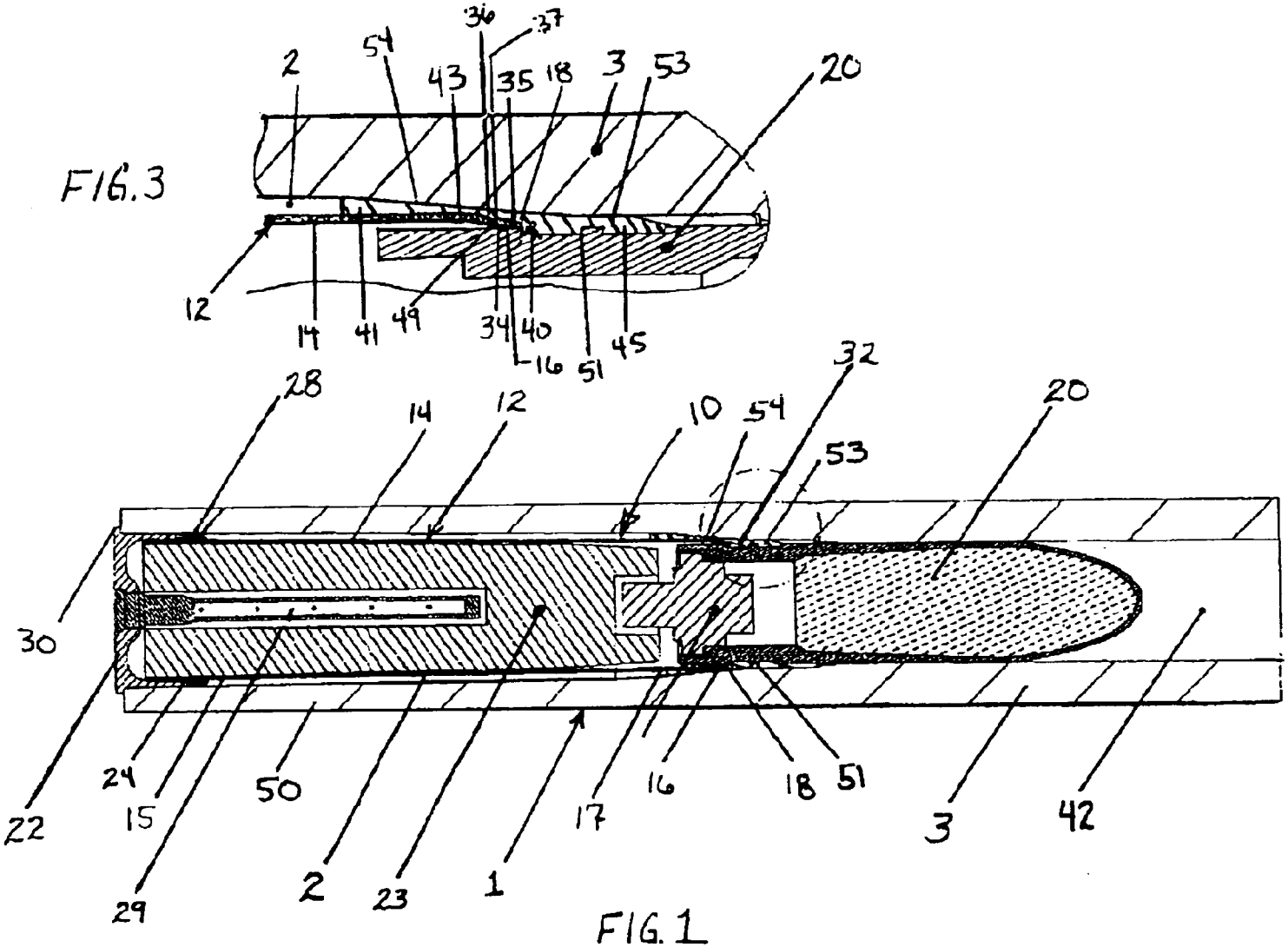
FIG. 1 is a cross-sectional view of an ammunition round assembly of one embodiment of the present invention.
FIG. 3 is an enlarged cross-sectional detail view of an attachment sleeve interconnecting a projectile and a combustible case body of the embodiment of FIG. 1.

FIG. 1 is a cross-sectional view of an ammunition round assembly 10 in accordance with one embodiment of the present invention. The ammunition round assembly 10 includes components that, when assembled, conforms to an industry standard outline of a 105 mm×617 mm cartridge case. This configuration permits the insertion of the ammunition round assembly 10 into a selected firing device 1 with a firing chamber 2 and a barrel 3, such as a standard M68 cannon firing chamber in preparation for firing. The ammunition round assembly 10 in one embodiment can be configured to conform to different dimensions or sizes for use with other armament systems.

The ammunition round assembly 10 has a combustible cartridge case body 12 with sidewalls 14 extending between a bottom end portion 15 and a top end portion 17. The top end portion 17 has a tapered case shoulder 16. A case neck 18 has an open end, also referred to as a case "mouth,"

shaped and sized to removably receive a lower portion projectile 20. The cartridge case body 12 in one embodiment is fabricated from a molded resinated, short-fiber composite whose main constituent is nitrocellulose, an energetic material that is substantially fully consumed upon firing. The combustible composite material is made by Armtec Defense Products of Coachella, Calif. The illustrated case body 12 is a one-piece configuration although alternate embodiments can have a multiple-piece configuration.

The bottom end portion 15 of the case body 12 is assembled to a composite case base 22, sometimes referred to as a "stub base," that forms a closed-ended bottom of the ammunition round assembly 10. The case body 12 and case base 22 contain a propellant charge 23, which is ignited by an ignition device 29, such as a primer, when the ammunition round assembly 10 is fired.

Figure 2:
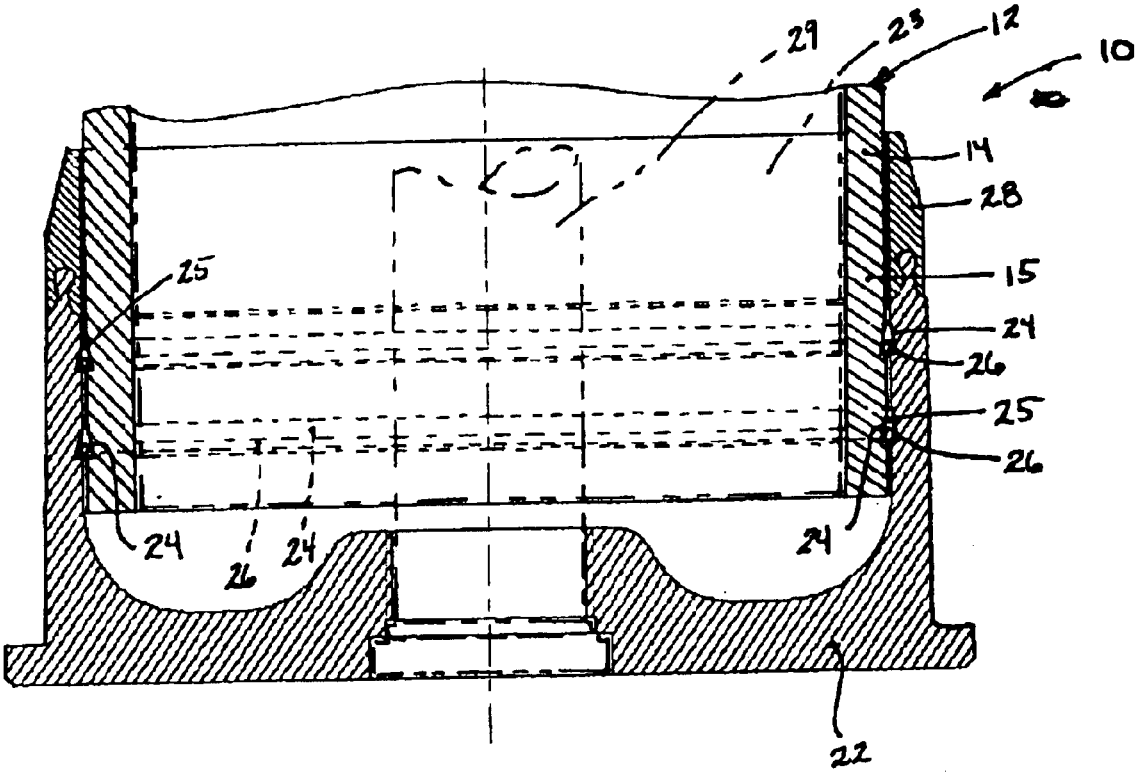
FIG. 2 is an enlarged cross-sectional view of an interface between a base and case body of the assembly of FIG. 1.

FIG. 2 is an enlarged cross-sectional view of the case base 22 and the bottom end portion 15 of the case body 12. The propellant charge 23 and ignition device 29 are not shown in FIG. 2 for purposes of illustration. The assembly interface between the case body 12 and the case base 22 in the illustrated embodiment is in the form of a male (case body)/female (case base) type of joint. The case base 22 and the bottom end portion 15 of the case body 12 each have a plurality of shaped retaining grooves 24 formed therein. The retaining grooves 24 are positioned so that the grooves in the case base 22 are aligned with and radially outward from the retaining grooves in the case body 12. Accordingly, the adjacent, aligned retaining grooves 24 form a locking groove 25 between the case base 22 and the case body 12. The illustrated embodiment shows two retaining grooves 24 in each of the case base 22 and the case body 12, although each can have, in alternate embodiments, only one retaining groove, or more than two retaining grooves.

In the illustrated embodiment, each of the locking grooves 25 contains an open-ended locking ring 26 that serves to structurally lock the case body 12 to the case base 22 while also permitting the transmittal of structural loads between the case body and the case base. In one embodiment, the locking ring 26 is a C-shaped ring formed from a suitable material, such as a spring steel alloy or the like, which may or may not have a circular cross sectional shape.

The retaining grooves 24 in the illustrated embodiment each have a generally triangular shape, and the opposing grooves in the case base 22 and case body 12 are configured as mirror images, thereby forming opposing right triangles. The locking ring 26 spans across the interface between the two opposing retaining grooves 24 in the case body 12 and case base 22. The triangular shape of the retaining grooves 24, in conjunction with the biased movement of the C-shaped locking rings 26, allows the bottom end portion 15 of the case body 12 to be inserted into the case base 22 and securely held in place.

During insertion, the C-shaped locking ring 26 is forced radially outwardly by the case body 12 into the outer corner of the triangular retaining groove 24 in the case base 22. Simultaneously, the C-shaped locking ring 26 is forced open at its open ends, increasing the locking ring's inner diameter enough to allow the case body 12 to slide into the case base 22. As the combustible case body 12 approaches its optimum insertion depth into the case base 12, the retaining grooves 24 in the case base and body come into alignment opposite each other. At this point, the locking ring 26 contracts slightly as it moves at least partially into the retaining groove 24 in the case body 12 so as to secure the case base to the case body. A viscous, environmental sealant is added to the volume of the retaining grooves 24 around the locking ring 26 and also to the cylindrical surfaces of the case base 22 and the case body 12 adjacent to the retaining grooves. In one embodiment, the sealant is an adhesive that provides an additional securing means between the case body 12 and the case base 22. The sealant/adhesive feature along with the biased flexibility of the locking rings 26 provides for a measure of longitudinal movement that serves to absorb shocks that may occur when the complete ammunition round assembly 10 is loaded into the firing chamber 2 and comes to an abrupt stop.

The case base 22 in one embodiment is of a composite nature consisting of a metallic cup-shaped structure with a cylindrical, elastomeric sealing ring 28 mated to an open end of the structure. The closed end of the case base 22 provides a solid mounting feature for the primer or other ignition device 29 that ignites the propellant charge 23. The outside edge of the case base's closed end defines a rim 30 configured for properly locating the ammunition round assembly 10 in the firing chamber 2 prior to firing. The rim 30 is also configured for removing the case base 22 from the firing chamber 2 after firing.

Referring again to FIG. 1, the projectile 20 is seated in the top end portion 17 of the case body 12 above the propellant charge 23, and securely held in place with a firm structural attachment sleeve 32. The attachment sleeve 32 of the illustrated embodiment is manufactured from a stiff, yet deformable plastic-type material, such as Nylon or the like. While the illustrated embodiment uses a sleeve-shaped attachment structure, other attachment members or structures could be used.

The attachment sleeve 32 has one end portion that extends over the case neck 18 and releasably engages a portion of the tapered case shoulder 16. The other end of the attachment sleeve 32 extends over and releasably engages a portion of the projectile 20. FIG. 3 is an enlarged cross-sectional view of the attachment sleeve 32 engaging the tapered case shoulder 16 and the projectile 20. The tapered case shoulder 16 of the illustrated embodiment has an annular engagement flange or ridge 34 that forms a connection member releasably engaged by the attachment sleeve 32. In the illustrated embodiment, the annular ridge 34 is a sawtooth-shaped ridge machined into the tapered case shoulder 16. The sawtooth-shaped ridge 34 has a tapered surface 35 that intersects an engagement surface 37. The tapered surface 35 extends radially inwardly and toward the case neck 18. The engagement surface 37 extends radially inwardly from its intersection with the tapered surface 35 and is configured to engage the attachment sleeve 32.

The attachment sleeve 32 has lower, intermediate and upper portions. A tapered lower portion 41 extends over the outer surface of the case shoulder 16 below the annular ridge 34. The tapered lower portion 41 is shaped to generally correspond to the tapered portion of the firing chamber 2 approaching the inner diameter of the barrel 3. The tapered lower portion 41 is also shaped to generally match the profile of the tapered case shoulder 16 over the length of the interface surface.

An intermediate connection portion 43 of the attachment sleeve 32 extends over the tapered case shoulder 16 and the annular ridge 34. The intermediate connection portion 43 has an annular, inverted, sawtooth-shaped engagement ridge 36 that mates with the annular ridge 34 on the case shoulder 16. The sawtooth-shaped ridge 36 has an engagement surface 49 that mates and locks with the engagement of the case body's annular ridge 34.

An upper connection portion 45 of the attachment sleeve 32 is substantially cylindrical and structurally mates with the projectile 20 in the manner of an interference shrink fit upon the projectile. The projectile 20 of the illustrated embodiment has a band 51, such as a rotating/driving band for use with a rifled barrel 3, or an obturating band for use with a smooth-bore barrel. The attachment sleeve's upper portion 45 has an integral annular connection portion 53 that forms a secondary mechanical locking feature extending over and bearing against the forward edge of the projectile's band 51. The annular connection portion 53 securely retains the attachment sleeve 32 on the projectile 20 to securely hold the projectile on the case body 12 until the ammunition round assembly 10 is fired.

As best seen in FIG. 3, the intermediate connection portion 43 of the attachment sleeve 32 has a groove 40 machined or otherwise formed on an inside surface generally adjacent to the projectile body 20 just forward of the case neck 18. The groove 40 in the illustrated embodiment is configured to allow the radial collapse of the tapered portion of the intermediate connection portion 43 as the projectile and attachment sleeve 32 travel together into the barrel bore 42 (FIG. 1) upon firing. The groove 40 is also configured to aid in the discard of this collapsed portion of the attachment sleeve 32 when the projectile 20 exits the barrel 3 without adversely affecting the rotational balance of the spinning projectile and, hence, its accuracy.

Figure 4:
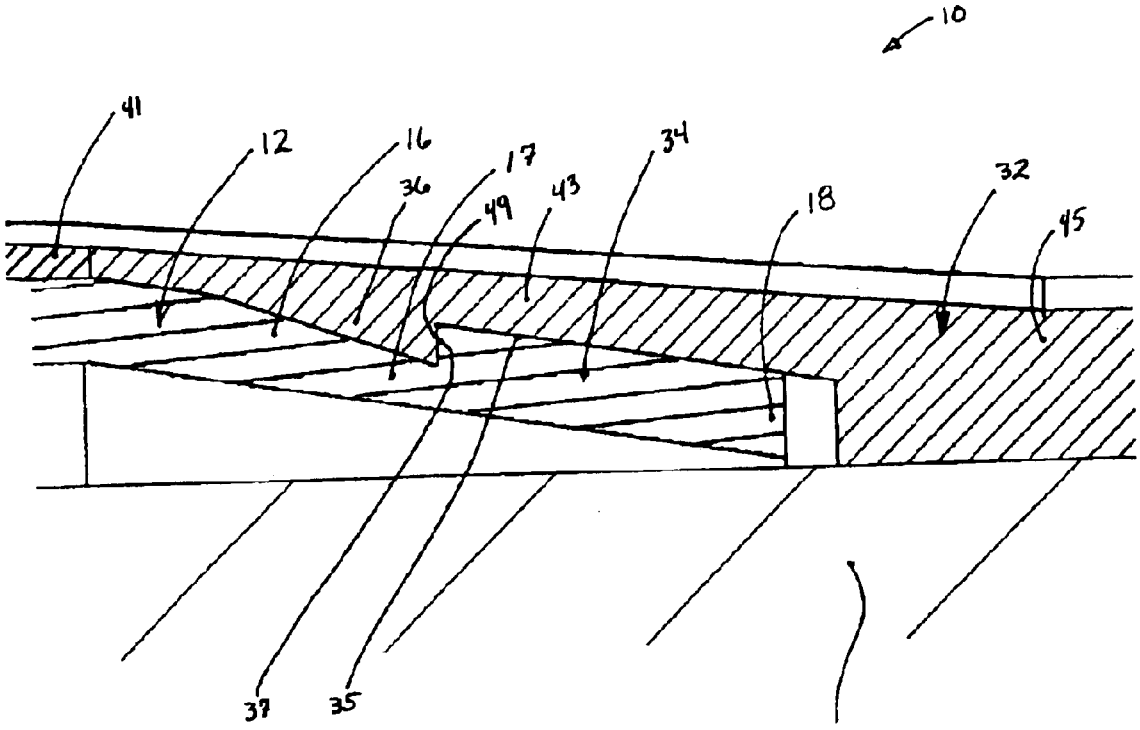
FIG. 4 is an enlarged cross-sectional view showing a portion of the attachment sleeve and an engagement member on the case body's top end portion in accordance with an alternate embodiment.

FIG. 4 is an enlarged cross-sectional view of the intermediate connection portion 43 of the attachment sleeve 32 and the annular ridge 34 of the tapered case shoulder 16 in accordance with an alternate embodiment. In this embodiment, the intermediate connection portion 43 of the attachment sleeve 32 does not have the groove 40 at the transition to the upper connection portion 45 as in the embodiment illustrated in FIG. 3. The attachment sleeve 32 is made of a material, such as a selected Nylon or the like, that will deform to conform to the inner diameter dimension of the barrel 3 (FIG. 1) when the ammunition round assembly 10 is fired.

Figure 5:
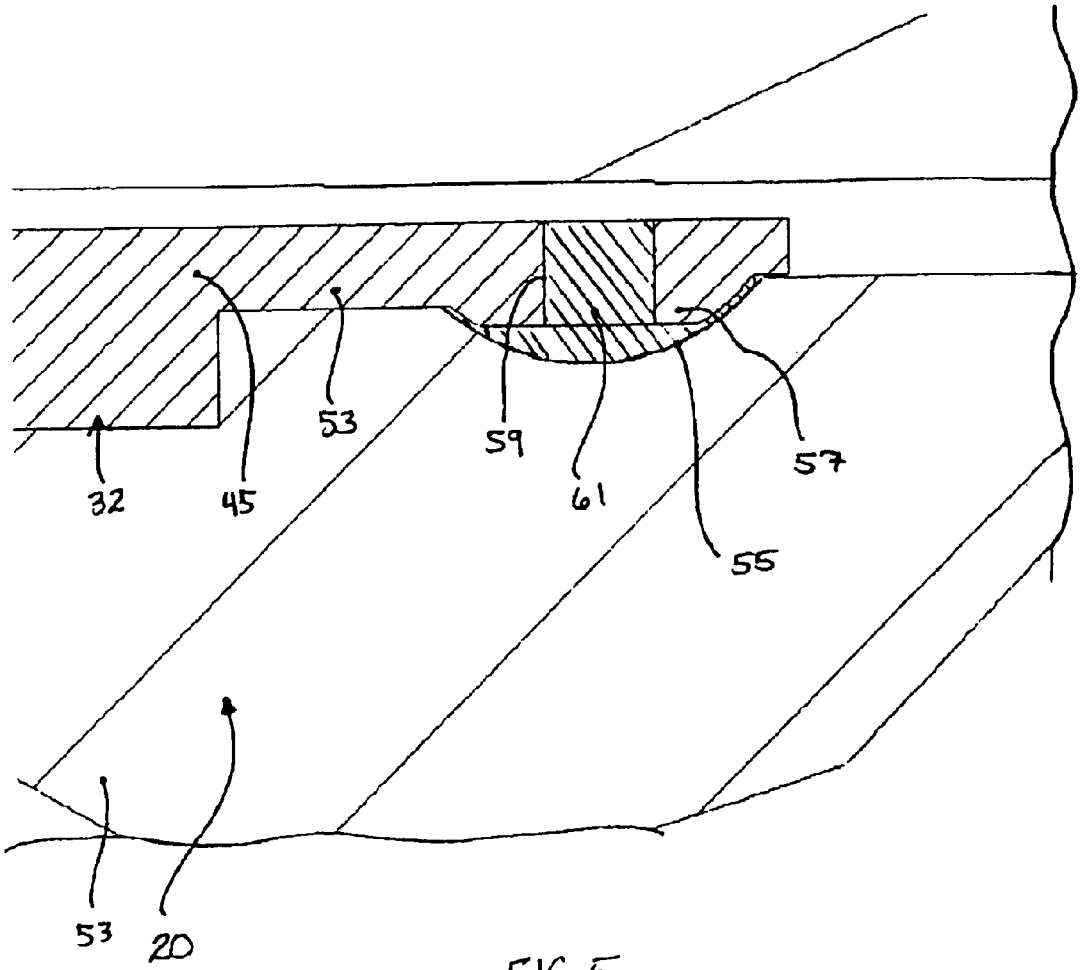
FIG. 5 is an enlarged cross-sectional view of an upper portion of the attachment sleeve in accordance with an alternate embodiment.

FIG. 5 is an enlarged cross-sectional view of the upper connection portion 45 of the attachment sleeve 32 connected to the projectile 20 in accordance with an alternate embodiment. The aft end portion of the projectile 20 has a crimping groove 55 formed by a circumferential, generally semicircular indentation around the projectile. The upper portion 45 of the attachment sleeve 32 has an annular band 57 projecting radially inwardly and at least partially into the crimping groove 55. The annular band 57 has a plurality of small apertures 59 therein that communicate with the crimping groove 55. During assembly of the attachment sleeve 32 onto to the projectile 20, a curing resin-type adhesive 61, such as an epoxy or the like, can be introduced into the crimping groove 55 through the small apertures 59. The adhesive 61 in the illustrated embodiment substantially fills the crimping groove 55 and is in contact with the internal surface of the attachment sleeve 32. The adhesive 61, upon curing, forms an adhesive bond between the projectile 20 and the attachment sleeve 32 as well as forming a shear tie to react loads between the projectile and attachment sleeve by loading the adhesive bond in shear.

In operation, the complete ammunition round assembly 10 (FIG. 1) is seated in the firing chamber 2 with the breech closed and secured ready for firing. Upon firing, the ignition device 29 functions, igniting the main propellant charge 23 from the center axis of the case body 12. As the main propellant charge 23 begins to burn radially outwardly toward the combustible case body 12, the propellant gas evolved begins to pressurize the interior of the ammunition round assembly 10. The propellant gas quickly exerts a substantial force upon the projectile 20, the case base 22, the elastomeric sealing ring 28 around the case base, and the case body's sidewalls 14. When the flame front completely traverses the propellant charge 23, the flame front comes into contact with and ignites the sidewalls 14 of the combustible case body 12.

At a relatively low predetermined pressure and aided by the gas generated by the burning sidewalls 14 of the case body 12 near the case base 22, a portion of the elastomeric sealing ring 28 is driven radially outwardly and into contact with the firing chamber walls 50. The expanded sealing ring 28 effectively seals the rear portion of the firing chamber 2 from the propellant gas while the ammunition round assembly 10 is being fired. At nearly the same time, the sidewalls 14 of the case body 12, now burning on their inside surfaces, are expanded radially outwardly across the initial clearance between sidewalls and the firing chamber walls 50 by the internal pressure generated by the propellant gas. This radial expansion continues until the combustible case body 12 is driven into contact with the firing chamber walls 50.

The radial expansion of the case body 12 results in the sidewalls 14 of the combustible case body 12 being subjected to a circumferential tension stress overwhelmingly greater than the ultimate tensile strength of the combustible material of the case body. As a result of this circumferential tension or stress, the case body 12 breaks apart into shards, thereby greatly increasing the exposed area to the combustion taking place in the propellant charge 23 and on the inner sidewalls 14 of the case body 12. As the combustion in the firing chamber 2 continues, the combustible cartridge case body 12 is substantially completely consumed, thereby leaving the firing chamber walls 50 to contain the propellant gas pressure.

At a pressure sufficient to shear the connection between the annular ridges 34 and 36 of the case body 12 and attachment sleeve 32, respectively, the projectile 20 begins its journey down the barrel 3, known as "shot start." When the barrel 3 is a rifled barrel, the projectile 20 travels a small measured distance away from the case body 12 to the point where the projectile's rotating/driving band 51 engages the barrel's rifling grooves. At this point, the rifling grooves are forced into the rotating/driving band 51 and also into the attachment sleeve 32, thereby "engraving" the attachment sleeve. As the rifling grooves engrave the attachment sleeve 32, the upper portion 45 of the attachment sleeve, which connects to the projectile body, is cut through or nearly so. This cutting action prepares the attachment sleeve 32 to be discarded upon the projectile's emergence from the barrel (known as "shot exit") without adversely affecting the rotational balance of the projectile 20 and, hence, its flight stability.

As the projectile 20 experiences shot start, the tapered lower portion 41 of attachment sleeve 32 comes into contact with the tapered forward section 54 of the firing chamber 2. The tapered lower portion 41 is initially larger in diameter than the barrel bore 42, but the continuing projectile travel into the bore causes the tapered lower portion to be swaged-down to a sufficiently smaller diameter to allow its travel with the projectile 20 down the barrel 3. This swaging action in one embodiment is aided by the internal groove 40 in the internal surface of the attachment sleeve 32 at the transition between the intermediate connection portion 43 and the upper portion 45. The internal groove 40 functions in the manner of a "living hinge" pivoting on the unbroken outer surface of the attachment sleeve 32 while the inner surface void formed by the groove serves as a repository for displaced sleeve material during the swaging process.

As the projectile 20 exits the barrel 3 at the muzzle, there is, for a very brief moment, a condition where the projectile has in fact left the muzzle, but at the same time, the swaged-down tapered lower portion 41 of the attachment sleeve 32 will be in the act of just exiting the barrel. This condition yields a configuration where the relatively high-pressure propellant gas is contained in the barrel 3 by only the swaged-down lower portion 41 of the attachment sleeve 32. The propellant gas in this configuration will subject the swaged-down lower portion 41 to a large internal pressurization loading that far exceeds the ultimate strength of the attachment sleeve 32 material and in the opposite direction of the loading imposed by the swaging process. This pressurization loading on the attachment sleeve 32 forces the lower and intermediate portions 41 and 43 radially outwardly in a flowering action.

The internal groove 40 again acts as a living hinge, but in this case nothing limits the outward flowering movement of the attachment sleeve 32, such that the material of the attachment sleeve 32 is strained to the point where it breaks. In one embodiment, this break point is the outer surface of the internal groove 40 as the living hinge is broken. In another embodiment without the groove 40, the break point on the attachment sleeve 32 is approximately at the transition between the intermediate connection portion 43 and the upper portion 45. This breaking-away action of the attachment sleeve 32 is accomplished as a predetermined, repeatable process that maintains the rotational balance of the projectile 20 and thus does not impact the accuracy of the projectile in its trajectory to the target. The upper portion of the attachment sleeve 32 cut through or nearly so by the rifling is also separated from the projectile 20 and discarded by the action of centrifugal force from the spinning projectile. Separation of the attachment sleeve 32 from the projectile 20 at shot exit is also aided by the flow of propellant gases blowing out of the barrel's muzzle, known as "blow down."

Upon projectile shot exit from the muzzle of the barrel 3, the propellant gas quickly vents to the atmosphere, and the pressure in the entire barrel returns to ambient pressure. At this time, the elastomeric sealing ring 28 on the case base 22 relaxes from the expanded position approximately to its original diameter. This relaxation process reestablishes the initial small diametrical clearance between the elastomeric sealing ring 28 and the firing chamber walls. The spent case base 22 can then be quickly ejected from the firing chamber 2, and another live ammunition round assembly 10 can be quickly and easily chambered and fired.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. An ammunition round assembly fireable from a firing device of a known caliber, comprising:

a cartridge body having top and bottom end portions, the bottom end portion having a first retaining groove therein, the cartridge body being made of a combustible material configured to be consumed in combustion upon firing of the ammunition round assembly from the firing device;

a base connected to the bottom end portion of the cartridge body, the base having a second retaining groove radially adjacent to the first retaining groove, the first and second retaining grooves defining a locking groove between the base and the cartridge body;

a retention member in the locking groove, the retention member engaging the cartridge body and the base and holding the cartridge body and the base together until ammunition round assembly is fired from the firing device;

a projectile coupled to the cartridge body, the projectile having a caliber that substantially matches the caliber of the firing device, the projectile having a retaining portion; and an attachment sleeve releasably connecting the projectile to the cartridge body, the attachment member having a first connection portion releasably engaging the too end portion of the cartridge body and a second connective portion releasably engaging the retaining portion of the projectile.

2. The ammunition round assembly of claim 1 wherein the cartridge body has an outer wall surface, and the first retaining groove is formed in the outer wall surface, and the case base has an inner wall surface, and the second retaining groove is formed in the inner wall surface.

3. The ammunition round assembly of claim 1 wherein the first and second retaining grooves each have a cross-sectional shape of a substantially right triangle.

4. The ammunition round assembly of claim 1 wherein the first and second retaining grooves have cross-sectional shapes that are substantially mirror images of each other.

5. The ammunition round assembly of claim 1 wherein the retention member is a radially expandable locking ring.

6. The ammunition round assembly of claim 1 wherein the retention member is an adhesive member in the locking groove and adhered to the base and the cartridge body.

7. The ammunition round assembly of claim 1 wherein the locking groove is a first locking groove, and the retention member is a first retention member, the cartridge case and the base include a second locking groove, and further comprising a second retention member in the second locking groove.

8. The ammunition round assembly of claim 1 wherein the base, the cartridge body, and projectile define a 105 mm armament round.

9. The ammunition round assembly of claim 1 wherein an upper portion of the cartridge body has an outer surface and a connection member on the outer surface, and the attachment sleeve extends over the upper portion's outer surface, the attachment sleeve having an inner engagement portion releasably engaging the connection member and resisting longitudinal motion of the projectile relative to the cartridge body.

10. The ammunition round assembly of claim 1 wherein the upper portion of the cartridge body has an outer connection member, and the first connection portion of the attachment sleeve has an inner connection member releasably engaging the outer connection member and configured to resist longitudinal motion of the projectile relative to the cartridge body.

11. The ammunition round assembly of claim 10 wherein the outer connection member is a flange formed in the cartridge body.

12. The ammunition round assembly of claim 10 wherein the inner and outer connection members are inverted, mating flanges.

13. The ammunition round assembly of claim 1 wherein the retaining portion of the projectile is at least one of a driving band and an obturating band.

14. The ammunition round assembly of claim 1 wherein the attachment sleeve configured to move with the projectile upon firing of the ammunition round assembly until the projectile exits the firing device.

15. The ammunition round assembly of claim 1 wherein the projectile has a driving band, and the attachment sleeve is connected to the driving band.

16. The ammunition round assembly of claim 1 wherein the attachment member is a nonmetallic sleeve.

17. An ammunition round assembly fireable through a barrel of a firing device of a known caliber, comprising:

a cartridge body having a top end portion with a first connection member thereon, the cartridge body being made of a combustible material configured to be consumed in combustion upon firing the ammunition round assembly in the firing device;

a projectile positioned adjacent to the top portion of the cartridge body having a caliber that substantially matches the caliber of the firing device; and an attachment sleeve having a second connection member releasably engaging the first connection member of the cartridge body, the attachment sleeve connected to a portion of the projectile spaced apart from the cartridge body, the attachment sleeve configured to resist longitudinal motion of the projectile relative to the cartridge body.

18. The ammunition round assembly of claim 17 wherein the first connection member is an annular flange formed in the cartridge body.

19. The ammunition round assembly of claim 17 wherein the first and second connection members are inverted mating flanges.

20. The ammunition round assembly of claim 17 wherein the projectile has an annular retaining portion formed therein, the attachment sleeve has a third connection member releasably engaging the annular retaining portion of the projectile.

21. The ammunition round assembly of claim 17 wherein the upper portion of the cartridge body has an outer surface and the first connection member is on the outer surface, and the attachment sleeve has an inner surface with the second connection member formed on the inner surface.

22. The ammunition round assembly of claim 17 wherein the attachment sleeve is a deformable sleeve that travels with the projectile in the barrel when the ammunition round assembly is fired.

23. The ammunition round assembly of claim 17 wherein the first connection member is integrally formed in the upper portion of the cartridge body, and the second connection member is integrally formed in the attachment sleeve.

24. The ammunition round assembly of claim 17 wherein the projectile has a driving band, and the second connection member of the attachment sleeve is releasably connected to the driving band.

25. The ammunition round assembly of claim 17 wherein the attachment sleeve is a nonmetallic sleeve.

26. An armament system, comprising:

a firing device having a firing chamber and a barrel with a first caliber;

an ammunition round assembly sized to seat in the firing chamber for firing through the barrel, the ammunition round assembly comprising:

a cartridge body having a top end portion with a first connection member thereon, the cartridge body being made of a combustible material configured to be consumed in combustion in the firing chamber upon firing the ammunition round assembly;

a base connected to the cartridge body and being releasably engagable by the firing device;

a propellant charge contained in the cartridge body and being configured to be consumed in combustion along with the cartridge body;

a projectile positioned adjacent to the top end portion of the cartridge body and sized to be fired through the barrel, the projectile having a second caliber that substantially matches the first caliber; and an attachment sleeve connected to the projectile and the cartridge body, the attachment sleeve having a second connection member releasably engaging the first connection member of the cartridge body, the attachment sleeve configured to resist longitudinal motion of the projectile relative to the cartridge body until the ammunition round assembly is fired.

27. An armament system, comprising:

a firing device having a firing chamber and a barrel with a first caliber;

an ammunition round assembly sized to seat in the firing chamber for firing through the barrel, the ammunition round assembly comprising:

a cartridge body having top and bottom end portions, the bottom end portion having a first retaining groove therein, the cartridge body being made of a combustible material configured to be consumed in combustion in the firing chamber upon firing the ammunition round assembly from the firing device;

a base connected to the bottom end portion of the cartridge body, the base being sized to be engaged by the firing device and having a second retaining groove radially adjacent to the first retaining groove, the first and second retaining grooves defining a locking groove between the base and the cartridge body;

a retention member positioned in the locking groove, the retention member engaging the cartridge body and the base in the first and second retaining grooves to hold the cartridge body and the base together until ammunition round assembly is fired from the firing device;

a unitary projectile positioned adjacent to the top end portion of the cartridge body and being deliverable along a trajectory to a selected target, the projectile having a second caliber that substantially matches the first caliber; and a breakable attachment sleeve releasably engaging the projectile and the cartridge body.

28. The ammunition round assembly of claim 1, wherein the attachment sleeve has an integral break portion formed therein adjacent to the projectile and configured to break and allow separation of the attachment sleeve and the projectile after the attachment sleeve and projectile exist the firing device.

29. The ammunition round assembly of claim 28 wherein the break portion is adjacent to an annular groove formed in the attachment sleeve.

30. The ammunition round assembly of claim 1 wherein the attachment sleeve has a flange portion moveable to a swagged down configuration when the attachment sleeve and projectile travel together as a unit through a barrel of the firing device, and being movable to a radially flared position when the attachment sleeve and the projectile exit the barrel.

31. The ammunition round assembly of claim 30 wherein the attachment sleeve has an annular groove formed therein adjacent to the flange portion, the flange portion being pivotable at the annual groove for movement between the swagged down configuration and the radially flared configuration.

32. The ammunition round assembly of claim 17 wherein the attachment sleeve has a flange portion moveable to a swagged down configuration when the attachment sleeve and projectile travel together as a unit through a barrel of the firing device, and being movable to a radially flared position when the attachment sleeve and the projectile exit the barrel.

33. The ammunition round assembly of claim 17 wherein the attachment sleeve has an integral break portion adjacent to the projectile and configured to break and allow separation of the attachment sleeve and the projectile after the attachment sleeve and projectile exist the firing device.

* * * * *

UNITED STATES PATENT AND TRADEMARK OFFICE

CERTIFICATE OF CORRECTION

PATENT NO. : 6,748,870 B2 
DATED : June 15, 2004
INVENTOR(S) : Paul D. Heidenreich et al.

It is certified that error appears in the above-identified patent and that said Letters Patent is hereby corrected as shown below:

Column 8,
Line 15, “too” should be -- top --;

Signed and Sealed this

Seventh Day of December, 2004

JON W. DUDAS
*Director of the United States Patent and Trademark Office*